United States Patent [19]

Wittbrodt

[11] Patent Number: 4,683,797

[45] Date of Patent: Aug. 4, 1987

[54] LINE CHARGE DETONATION INTERLOCK ASSEMBLY

[75] Inventor: Donald R. Wittbrodt, Warren, Mich.

[73] Assignee: The United States of America as represented by the Secretary of the Army, Washington, D.C.

[21] Appl. No.: 903,807

[22] Filed: Sep. 2, 1986

[51] Int. Cl.[4] ..... F41H 11/00

[52] U.S. Cl. ..... 89/1.13

[58] Field of Search ..... 89/1.13, 1.34, 36.08, 89/36.13, 1.11; 102/429, 428, 424, 427, 420; 200/85 R, 61.06, 61.07

[56] References Cited

U.S. PATENT DOCUMENTS

| | | | |
|---|---|---|---|
| 3,242,862 | 3/1966 | Stegbeck et al. | 89/1.13 X |
| 3,852,736 | 12/1974 | Cook et al. | 200/85 R X |
| 3,958,527 | 5/1976 | Iannacone | 200/85 R X |
| 4,577,181 | 3/1986 | Lipscher et al. | 200/85 R X |

FOREIGN PATENT DOCUMENTS

| | | | |
|---|---|---|---|
| 2226064 | 11/1974 | France | 89/1.13 |
| 2226065 | 11/1974 | France | 89/1.13 |

OTHER PUBLICATIONS

Robotic Obstacle Breaching Assult Tank (Robot) (photograph only–submitted by assignee in copending Ser. No. 856,260).

*Primary Examiner*—David H. Brown

*Attorney, Agent, or Firm*—Peter A. Taucher; John E. McRae

[57] ABSTRACT

An existing military system for clearing a path through an enemy mine field (by use of an explosively-charged line) is equipped with a safety mechanism for preventing premature detonation of explosive charges. The safety mechanism includes means responsive to weight changes, incident to withdrawal of an explosively-charged line from a storage container. The weight-responsive mechanism permits electrical detonation of the explosive charges only when the container is emptied of the explosive charges.

4 Claims, 6 Drawing Figures

LINE CHARGE DETONATION INTERLOCK ASSEMBLY

GOVERNMENT INTEREST

The invention described herein may be manufactured, used, and licensed by or for the Government for governmental purposes without payment to me of any royalty thereon.

BACKGROUND AND SUMMARY OF INVENTION

This invention relates to an electro-mechanical means for preventing the premature detonation of explosives. The invention was conceived especially for use in a mine-destruction system disclosed in U.S. patent application Ser. No. 856,260 filed on Apr. 28, 1986, and titled "Protective Box for Explosive Line Launcher".

The above-referenced patent application relates to the destruction of enemy mines in a mine field, i.e. clearing a path through an enemy minefield. The patent application shows a military vehicle equipped with a mechanism for launching a small rocket (missile). The aft end of the rocket is attached to a flexible line that is stored in an open-topped container positioned beneath the rocket-launch mechanism. The flexible line has a series of explosive blocks spaced along its length. In a typical system the line is on the order of three hundred feet long.

In use of the apparatus, the vehicle may be driven up to an enemy mine field. With the vehicle in a stopped (motionless) condition, the rocket may be launched into the space above the mine field. As the rocket travels through space it pulls the flexible line out of the container. When the rocket falls to earth the flexible line is in a stretched straight condition lying on the terrain (above/on the earth where suspected enemy mines are buried).

While the flexible line is lying on the terrain an electrical signal is directed from the vehicle into one of the explosive blocks (attached to the line); that explosive block is detonated, to destruct any enemy mines in its vicinity. The detonation force detonates the other explosive blocks, such that all (or substantially all) enemy mines along the path taken by the line are destroyed.

The aim of the described system is to provide a mine-free path through the enemy mine field for passage of friendly vehicles and troops.

For proper operation of the described system it is essential that the rocket is launched (delivered) to its destination point before an electric detonation signal is delivered to the explosive blocks. Were the detonation signal to be generated while the explosives were still in the container (on the vehicle) the resultant explosion would cause tremendous damage to the vehicle, and possible loss of life.

The present invention relates to a safety mechanism for preventing inadvertent or accidental detonation of the explosive blocks while said blocks are stored within the container. The safety mechanism includes means responsive to the weight of the loaded container for automatically deactivating-activating the detonation circuit. The explosives can be detonated only when the container is empty, i.e. after the explosives are in place on enemy terrain.

THE DRAWINGS

FIGS. 1 AND 2—GENERAL ARRANGEMENT

Figure 2:
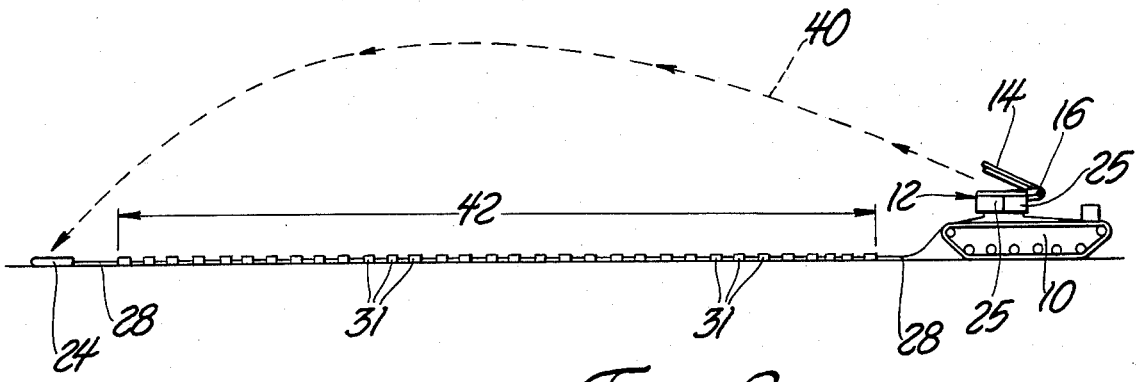
FIG. 2 is a side elevational view of a military vehicle having the FIG. 1 mechanism incorporated thereon.
Figure 1:
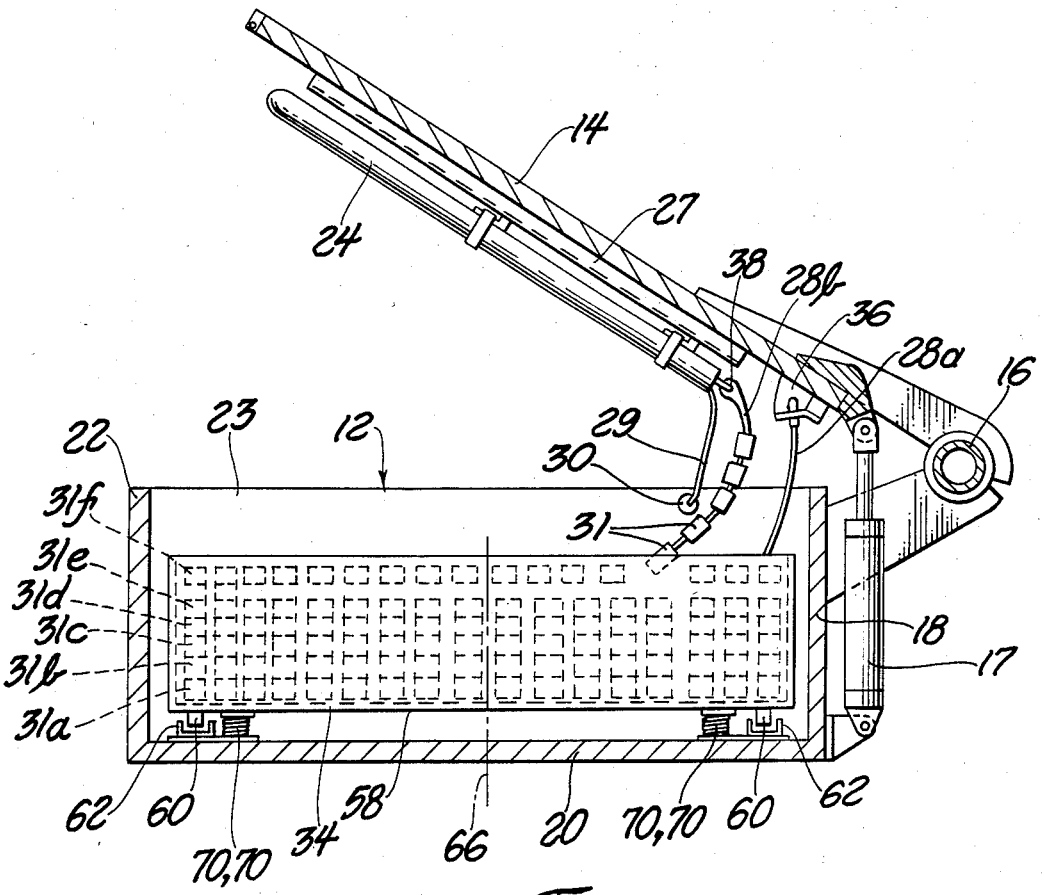
FIG. 1 is a sectional view through a mine-destruction mechanism suitable for using my invention.

Referring in greater detail to FIGS. 1 and 2, there is shown a military tracked vehicle 10 having an armored box structure 12 thereon (in the position normally occupied by the turret). Box structure 12 is equipped with a lid (cover) 14 having a hinged connection 16 with the box rear wall 18. The box includes a bottom wall 20, front wall 22, and one side wall 23. The other side of the box is closed by two swingable doors 25 (FIG. 2) having hinged connections with walls 18 and 22. FIGS. 1 and 2 are of a semi-structural character. A more detailed description of box structure 12 is contained in aforementioned patent application, Ser. No. 856,260. That application shows two box structures (similar to structure 12) in side-by-side relation. Lid 14 is movable between a non-illustrated prone position engaged with the upper edges of walls 18, 22 and 23, and a second position inclined upwardly and forwardly, as shown. The lid is operated between its prone (closed) position and its inclined (rocket-fire) position by means of a hydraulic cylinder 17. On its undersurface the lid carries a launcher (rail) 27 for a rocket 24. The rocket contains a solid propellant motor that can be ignited by an electric signal delivered through an electric line 29. One end of line 29 connects to a fuse in the aft end of the rocket; the other end of line 29 connects to an electrical plug 30 that plugs into an electric control circuit for the rocket-fire operation. FIG. 2 shows (on a reduced scale) rocket 24 after launch and travel along a representative flight path 40. The aft end of the rocket is connected to a flexible line (nylon cable) 28 having a plural number of explosive blocks 31 spaced therealong. In a typical system flexible line 28 has a length in excess of three hundred feet; such a line would have about six hundred explosive blocks therealong.

EXPLOSIVELY-CHARGED LINE STORAGE

FIG. 1 shows the mechanism prior to rocket launch. Flexible line 28, and the associated explosive blocks 31, are stored within a rectangular open-topped container 34 located within box structure 12. The explosive blocks are arranged in serpentine fashion in superimposed layers, designated by numerals 31*a*, 31*b*, 31*c*, 31*d* and 31*e* in FIG. 1. The term "serpentine" refers to a sinuous, continuous alignment of the blocks within a given layer, consistent with a reasonably close packing of the blocks within available container dimensions. In a typical example there would be five layers, each layer having 120 blocks (total of 600 explosive blocks). The end one of the blocks in the lowermost layer has a flexible section of line 28*a* connected to a detachable anchorage 36 on lid 14. Some details of anchorage 36 are shown in above-mentioned patent application, Ser. No.

856,260. The end one of the blocks in the uppermost layer has a flexible section of line 28*b* connected to an anchorage 38 on the rear end of rocket 24.

DISCHARGE AND DETONATION OF EXPLOSIVE BLOCKS

When rocket 24 is launched it pulls line 28 (and explosive blocks 31) out of container 34. The upper layer of blocks 31 leaves the container first, the next layer second, and so on until all of the blocks are out of the container. FIG. 2 represents the condition after the rocket has landed. Numeral 42 represents the length of terrain spanned by the explosive blocks; in a typical situation this length would be on the order of three hundred feet. The explosive blocks may be detonated by an electric signal applied from the vehicle through an electric line extending from anchorage 36 along section 28*a* of mechanical line 28. A small explosive squib detonator at the first explosive block initiates the process. Vehicle 10 has a source of electrical power therein sufficient to energize rocket 24 and subsequently detonate the explosive blocks 31.

Vehicle 10 may be an unmanned vehicle controlled remotely from a safe distance in back of the battle zone. In that case the electric signals for operating rocket 24 and explosive blocks 31 may be controlled by switches that are opened/closed via radio signals from the remote control point. It is also possible to remotely control the vehicle via a fiber optic cable, as outlined in aforementioned patent application, Ser. No. 856,260. In a representative scenario a radio transmitter at the control point transmits signals of different frequencies to a multi-channel radio receiver in the tank (vehicle 10). Impulse converters apply the signals to solenoids (relays) that control the respective switches in the energization circuits for rocket 24 and explosive blocks 31. Alternatively, vehicle 10 may be operated in conventional fashion by one or more soldiers seated inside the vehicle. In that case the electric signals for operating rocket 24 and detonating explosive blocks 31 may be controlled by manual switches within the vehicle.

CONTROL CIRCUITRY

Figure 6:
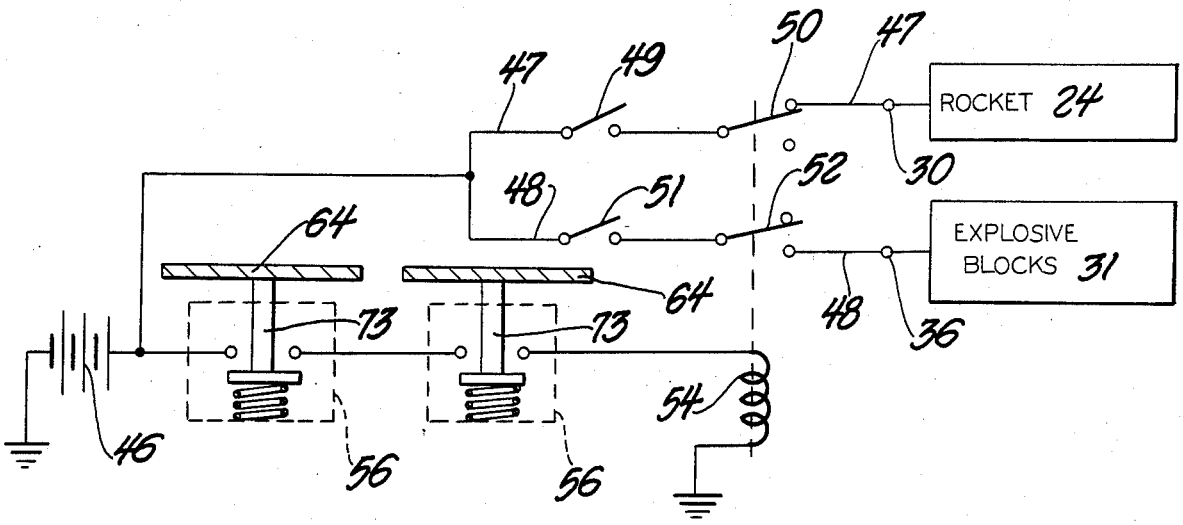
FIG. 6 is a diagram of an electrical circuit associated with the structure depicted in FIGS. 3 through 5.

FIG. 6 schematically illustrates some features of a circuit that can be used to energize rocket 24 and explosive blocks 31. Power source 46 supplies current to two parallel lines 47 and 48 leading respectively to aforementioned electrical connection points 30 and 36. Line 47 has two control switches 49 and 50 therein. Line 48 has two control switches 51 and 52 therein. Switches 49 and 51 are the primary switches used to operate the rocket and detonate the explosive blocks 31; these switches may be radio-controlled (in the case of an unmanned vehicle) or manually-controlled (when the vehicle is manned).

Switches 50 and 52 are safety switches designed to prevent detonation of explosive blocks 31 until rocket 24 has been fired and the explosively-charged line has been pulled out of container 34. Switches 50 and 52 are component parts of an electrical relay controlled by solenoid winding (coil) 54. When the winding is inactive switch 50 is in a circuit-closed condition, and switch 52 is in a circuit-open condition. Under such conditions switch 49 may be operated to fire rocket 24.

Relay winding 54 is energized by weight-responsive switch means 56 located within box 12 beneath container 34. Assuming that rocket 24 is properly fired and that the explosively-charged line is drawn onto the terrain (as shown in FIG. 2), the weight-responsive switch means 56 will respond to the reduced weight of container 34, to thereby complete the energization circuit for winding 54. Switch 50 will open and switch 52 will close. With switch 52 in a circuit-closed condition, switch 51 may be operated to detonate the explosive blocks 31. It will be noted that it is impossible to detonate explosive blocks 31 while the explosively-charged line is stored within container 34 (FIG. 1). Blocks 31 can be detonated only after the explosively-charged line has been drawn out of container 34.E

WEIGHT-RESPONSIVE ACTUATOR

The weight-responsive mechanism is shown in FIGS. 1, 3, 4 and 5. Bottom wall 58 of container 34 has two laterally-spaced runners (skids) 60 of box cross-section attached thereto. The spacing of runners 60 corresponds to the fork spacing on a conventional fork lift truck (not shown), to permit the container to be transported via forklift to/from the space circumscribed by armored box 12 (when doors 25 are opened). The bottom wall 20 of box 12 has two upwardly-opening channels 62 thereon for orienting container 34 in box 12.

The aforementioned weight-responsive mechanism comprises two elongated plates 64 located inboard from channels 62, but still spaced laterally from imaginary centerline 66 located midway between channels 62. A second plate 68 is located below each plate 64; two coil-type compression springs 70 are trained between each plate 68 and the associated plate 64. Clips or similar attachment devices are used to affix the ends of the springs to the two plates 64 and 68.

Figure 3:
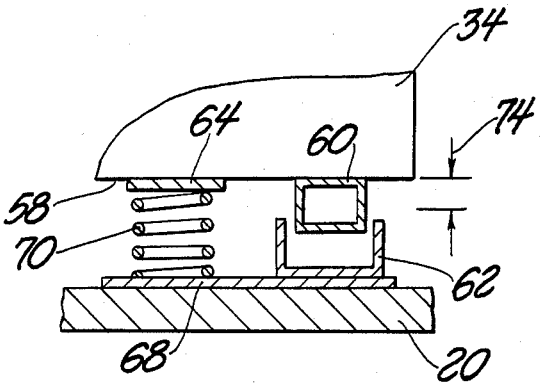
FIG. 3 is an enlarged sectional view of a structural detail used in the FIG. 1 mechanism.
Figure 4:
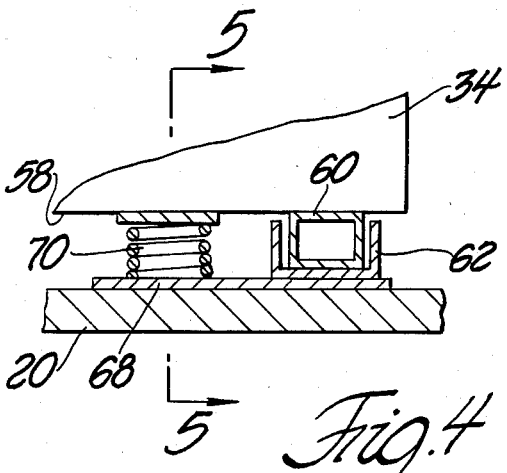
FIG. 4 is a view in the same direction as FIG. 3, but taken with certain components in a different condition of adjustment.
Figure 5:
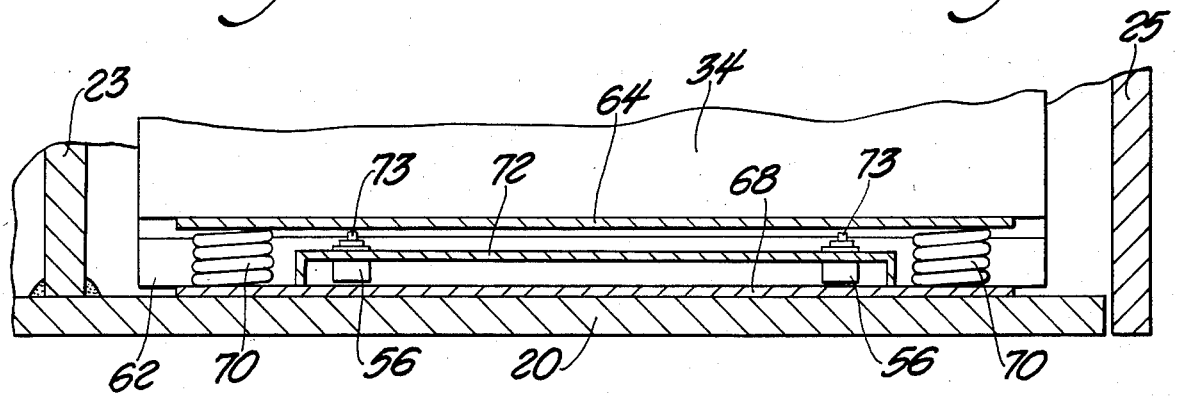
FIG. 5 is a sectional view on line 5—5 in FIG. 4.

The space between adjacent springs 70 is occupied by an elongated bracket structure 72. As shown in FIG. 5, structure 72 serves to mount the two switch structures 56 so that their operating plungers 73 are directly below the associated plate 64. Each plate 68 serves as a unitary mounting means for the associated springs 70, bracket 72 and channel 62. Each plate 68 thereby can accurately locate and mount the associated components prior to their disposition in armored box 12. FIG. 1 is drawn to such a small scale that plates 68 and 64 are not visible therein. FIGS. 3, 4 and 5 show the plate arrangement. Each plate 68 may be welded or screwed to box wall 20 (to operatively locate springs 70 and switches 56).

FIGS. 4 and 5 illustrate the positions of the weight-responsive components when container 34 is loaded with the explosively-charged line. Skids 60 (attached to container 34) rest on channel 62; springs 70 are compressed, and switch plungers 73 are depressed to switch-open positions (FIG. 6).

FIG. 3 illustrates the positions of the weight-responsive components when container 34 is empty, i.e. after the explosively-charged line has been drawn out of the container. Springs 70 are effective to lift container 34 away from its initial (loaded) position through a short distance 74. Distance 74 is sufficient to permit the switch plungers 73 to effect switch actuation to the circuit-closed condition.

In a typical situation container 34 would weigh on the order of 200 pounds, while the explosively-charged line would weigh on the order of 1200 pounds. Distance 74 (FIG. 3) would represent spring deflection due to 1200 pound force. There are four springs 70 in the system (two springs for each plate 64). Therefore each spring 70 has a rate wherein a force of about 300 pounds produces the deflection designated by numeral 74.

To summarize the operation, when container 34 10 (pre-loaded with explosively-charged line) is lowered into box 12 the container weight is sufficient to deflect springs 70 to the condition of FIGS. 4 and 5. Switches 56 are in the circuit-open positions (FIG. 6). Relay winding 56 is inactive (de-energized), such that switch 52 is in an open condition. It is impossible to detonate explosive blocks 31 even though switch 51 is closed (deliberately or accidentally).

When the explosively-charged line is withdrawn from container 34 the total container weight is appreciably reduced, e.g. from an initial value of 1400 pounds to a final value of 200 pounds. Springs 70 lift the unloaded container to the FIG. 3 condition wherein switches 56 are in the circuit-closed conditions. Relay winding 54 is energized to cause switch 52 to be closed. Switch 51 can then be operated to detonate the explosive blocks.

FIG. 6 shows two switches 56. In the actual arrangement, depicted in FIGS. 1, 3, 4 and 5, there are four switches 56 (two switches for each plate 64). Theoretically one switch 56 would be sufficient. However, four switches 56 are preferred to avoid possible malfunction due to a broken spring, spring overloading, switch actuation resulting from a partially-emptied container, or a tipped condition of the container due to an off-center relation of the container to the spring. Use of a plural number of switches is preferable to use of a single spring. The various switches 56 are in series electrical connection with one another, such that all switches must be actuated in order for the detonation circuit to be operable. This provides a fail-safe feature, counteracting mechanical idiosyncrasies in system performance.

ADVANTAGES OF THE DESCRIBED ARRANGEMENT

It is believed possible to build an electrical interlock (timer) system that would require switch 49 to be actuated before switch 51. Such a system would ensure the proper switch timing for at least partly preventing the premature detonation of explosive blocks 31 while they were still stored in container 34. However such a system would not be entirely fail-safe.

For example, an electrical interlock would not be effective if cable 28 were to become disconnected from anchorage 38 (at the aft end of rocket 24), or if cable 28 were to break at some point along its length. An electrical interlock would also not be effective if rocket 24 were to misfire (i.e. fail to launch). In either of these situations some part (or all) of the explosively-charged line would remain in container 34 even though switch 49 had been actuated to fire the rocket. Operation of switch 51 with explosive blocks 31 still in container 34 could cause extensive damage and/or possible loss of life.

The weight-responsive control system described herein is believed to have fail-safe advantages over an electrical interlock system.

The drawings show the rocket launch means as a rail located on the underside of a lid 14 for armored box 12. Bottom wall 20 of the box serves as a platform for charged-line container 34. Within the broad aspects of this invention, container 34 need not be protectively housed within an armored box, e.g. it is possible to eliminate the box side walls 18, 22 and 23. The details of rocket 24 and the rocket launcher may be varied while still utilizing the invention. Explosive charges 31 need not be a series of separate blocks, as shown in FIG. 1. Instead, explosive charges 31 may be interconnected to form a continuous elongated explosive system within a flexible support tube; such an explosive system is already known in the art.

I do not desire to be limited to the exact details of construction shown and described for obvious modifications will occur to a person skilled in the art, without departing from the spirit and scope of the appended claims.

I claim:

1. In a military system for destroying mines in an enemy mine field, said system comprising a platform (20), a rocket and rocket launch means disposed above the platform, a container (34) positionable on the platform below the rocket, a flexible mechanical line (28) of substantial length having explosive charges extending therealong, said line having its opposite ends connected to the launch means and to the rocket, said line and associated charges being stored in coiled condition within the container, said line and rocket being oriented so that after the rocket is launched the line and associated explosive charges are strung out on enemy terrain containing suspected mines, and a detonation circuit for detonating the explosive charges when they are in place on enemy terrain:

the improvement comprising electro-mechanical means for preventing detonation of the explosive charges while the explosive charges are stored in the container, said detonation-prevention means comprising switch means (56) for interrupting the detonation circuit, and weight-responsive actuator means for moving the switch means to a circuit-interrupt condition when the aforementioned container is loaded with explosive charges; said weight-responsive actuator means comprising two laterally spaced plates (64) extending horizontally above the platform substantially equidistant from an imaginary centerline taken through the space occupied by the container, said plates being floatably mounted to engage an undersurface of the container; and at least two springs trained between said platform and each plate to bias the plates upwardly against the container weight, said springs having similar force-rate characteristics, whereby each spring carries approximately the same share of the container weight; said springs being effective on the floatably-mounted plates to lift the container clear of the platform when the container is in an empty condition.

2. The improvement of claim 1 wherein said switch means comprises at least one switch underlying each plate, each switch including a plunger (73) located in the path taken by the associated plate when said plate is deflected downwardly by the container.

3. The improvement of claim 2, and further comprising a unitary mounting structure (68) for each plate and associated springs and switch; said mounting structure tying the plate, springs and switch together so that when the mounting structure is attached to the platform the switch is operatively oriented to the plate.

4. The improvement of claim 2 wherein the various switches are in series electrical connection with one another, whereby all switches must be actuated in order for the detonation circuit to be operable.

* * * * *